US008127729B2

(12) United States Patent
Takahashi et al.

(10) Patent No.: US 8,127,729 B2
(45) Date of Patent: Mar. 6, 2012

(54) VALVE TIMING CONTROL APPARATUS

(75) Inventors: Hiroki Takahashi, Chiryu (JP); Akio Imai, Kariya (JP)

(73) Assignee: Denso Corporation, Kariya (JP)

( * ) Notice: Subject to any disclaimer, the term of this patent is extended or adjusted under 35 U.S.C. 154(b) by 155 days.

(21) Appl. No.: 12/781,336

(22) Filed: May 17, 2010

(65) Prior Publication Data

US 2010/0288216 A1 Nov. 18, 2010

(30) Foreign Application Priority Data

May 18, 2009 (JP) ..... 2009-120264

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS

| | | | | |
|---|---|---|---|---|
| 7,624,710 | B2 * | 12/2009 | Uehama et al. | 123/90.17 |
| 2007/0199531 | A1 | 8/2007 | Sugiura et al. | |
| 2008/0083384 | A1 | 4/2008 | Morii | |

FOREIGN PATENT DOCUMENTS

| | | |
|---|---|---|
| JP | 2007-255412 | 10/2007 |
| JP | 2008-095550 | 4/2008 |
| JP | 2009-019595 | 1/2009 |

* cited by examiner

*Primary Examiner* — Ching Chang
(74) *Attorney, Agent, or Firm* — Nixon & Vanderhye PC

(57) ABSTRACT

A driven-side rotator is rotatable synchronously with a camshaft and is supported between a gear member and a sprocket member of the driving-side rotator in an axial direction. A stopper portion of the driven-side rotator is adapted to contact the driving-side rotator in a rotational direction to limit a change in a relative phase between the crankshaft and the camshaft. The stopper portion radially outwardly projects from a small diameter portion provided at one end part of the driven-side rotator. A large diameter portion is provided at the other end part of the driven-side rotator and has a radial size that is measured from a rotational axis to a radially outer peripheral surface of the large diameter portion and is equal to or larger than that of the stopper portion.

6 Claims, 8 Drawing Sheets

VALVE TIMING CONTROL APPARATUS

CROSS REFERENCE TO RELATED APPLICATION

This application is based on and incorporates herein by reference Japanese Patent Application No. 2009-120264 filed on May 18, 2009.

BACKGROUND OF THE INVENTION

1. Field of the Invention

The present invention relates to a valve timing control apparatus, which controls opening and closing timing of a valve that is driven by a camshaft through transmission of a torque from a crankshaft of an internal combustion engine.

2. Description of Related Art

In a known valve timing control apparatus, a first rotator and a second rotator are rotatable synchronously with a crankshaft and a camshaft, respectively. A planetary gear is meshed with a gear portion of the first rotator and a gear portion of the second rotator. A relative phase (hereinafter, referred to as an engine phase) between the crankshaft and the camshaft is changed through a planetary motion of the planetary gear.

Japanese Unexamined Patent Publication No. 2008-95550A (corresponding to US 2008/0083384A1) recites a valve timing control apparatus, in which stopper portions are formed in the second rotator that is coaxially received in the first rotator. When the stopper portions contact corresponding walls, respectively, of the first rotator in the rotational direction, the engine phase is limited. Here, when the engine phase is limited, the valve timing can be adjusted within an appropriate range, which is appropriate for driving the internal combustion engine.

In the case of the valve timing control apparatus recited in Japanese Unexamined Patent Publication No. 2008-95550A, the second rotator, which is supported by the first rotator, is constructed such that the stopper portions radially outwardly project at one axial end part of the second rotator to form a large diameter portion, and a small diameter portion is radially inwardly recessed from the large diameter portion at the other axial end part of the second rotator. Here, the axis of the second rotator can be easily tilted relative to the first rotator by vibrations transmitted from the internal combustion engine. As shown in FIGS. 8A-8C, the amount of tilt of the second rotator 1020 relative to the first rotator 1010 is determined as follows. That is, the second rotator 1020 is tilted by the amount, which corresponds to a support clearance C defined between the second rotator 1020 and the first rotator 1010, so that the opposed axial end parts of the second rotator 1020 contact the first rotator 1010.

With the above construction, there are two possible contact states of the second rotator 1020 relative to the first rotator 1010. In the first contact state, as shown in FIG. 8B, the non-protruding portion 1210*a* of the stopper portion 1200 contacts the first rotator 1010. In the second contact state, as shown in FIG. 8C, the stopper portion 1200 at the large diameter portion 1210 contacts the first rotator 1010. Therefore, the amount of tilt of the rotational axis O of the second rotator 1020 changes from time to time, so that frictional wearing and/or noises may be generated between the gear portion of the second rotator 1020 and the planetary gear.

SUMMARY OF THE INVENTION

The present invention is made in view of the above disadvantage. According to the present invention, there is provided a valve timing control apparatus that controls valve timing of a valve of an internal combustion engine, which is driven by a camshaft through transmission of a torque from a crankshaft of the internal combustion engine to open and close the valve. The valve timing control apparatus includes a first rotator, a second rotator and a planetary gear. The first rotator is rotatable synchronously with one of the crankshaft and the camshaft. The first rotator includes a first gear portion. The second rotator is coaxially received in the first rotator and is supported between a first-axial side part and a second-axial side part of the first rotator in an axial direction of the first and second rotators. The second rotator is rotatable synchronously with the other one of the crankshaft and the camshaft and includes a stopper portion and a second gear portion. The stopper portion is adapted to contact the first rotator in a rotational direction to limit a change in a relative phase between the crankshaft and the camshaft. The planetary gear is meshed with the first gear portion and the second gear portion and is adapted to make a planetary motion and thereby to change the relative phase between the crankshaft and the camshaft. The second rotator further includes a small diameter portion and a large diameter portion. The stopper portion projects radially outward at a circumferential part of the small diameter portion. The large diameter portion has a radial size, which is measured from the rotational axis of the first and second rotators to a radially outer peripheral surface of the large diameter portion and is equal to or larger than a radial size of the stopper portion that is measured from the rotational axis of the first and second rotators to a radially outer peripheral surface of the stopper portion. The small diameter portion and the large diameter portion of the second rotator are supported between the first-axial side part and the second-axial side part of the first rotator in the axial direction of the first and second rotators.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
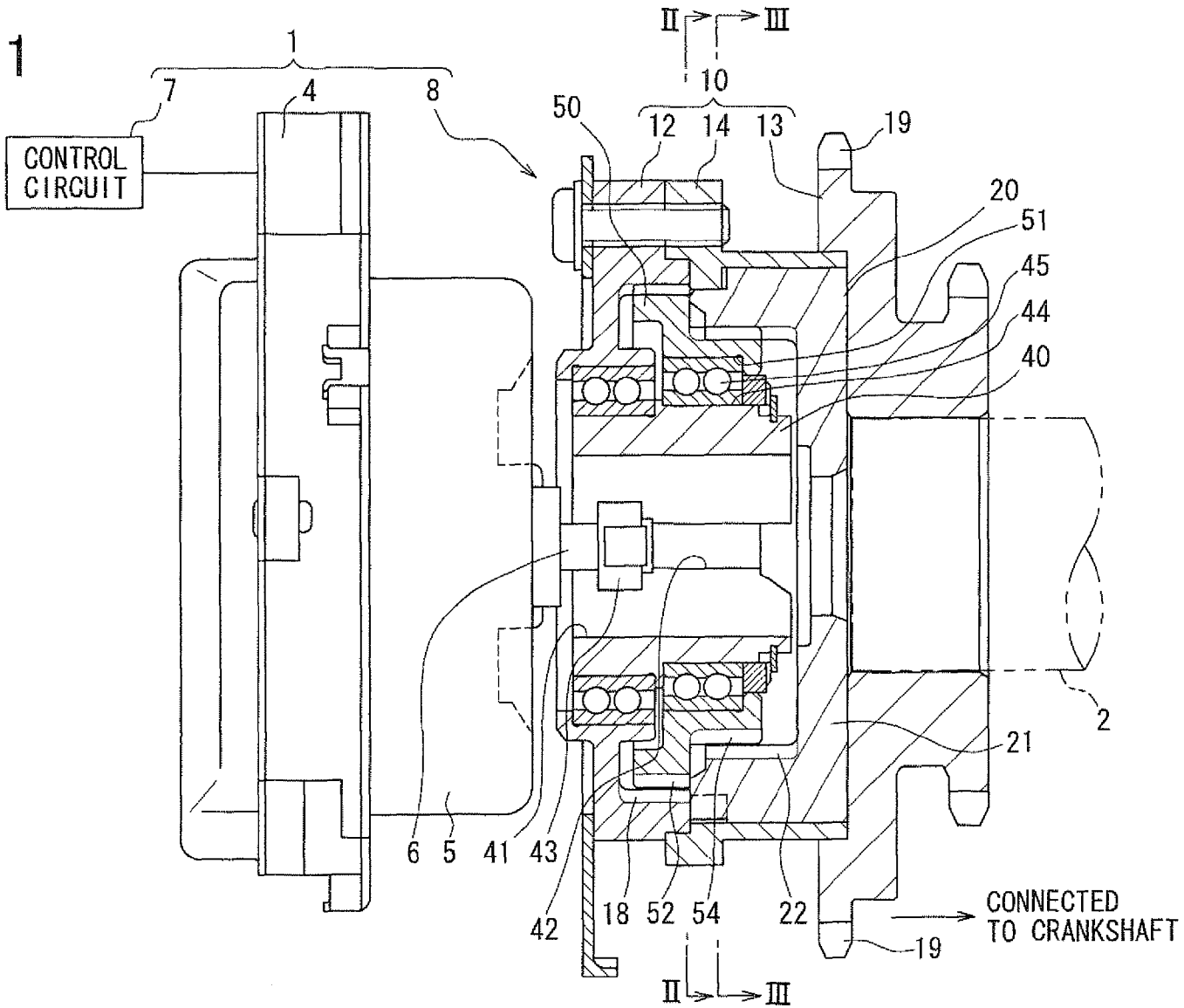
FIG. 1 is a cross-sectional view taken along line I-I in FIG. 2, showing a basic structure of a valve timing control apparatus according to an embodiment of the present invention.

An embodiment of the present invention will be described with reference to the accompanying drawings. FIG. 1 shows a valve timing control apparatus 1 according to an embodiment of the present invention. The valve timing control apparatus 1 is installed in a vehicle and is placed in a transmission system, which transmits an engine torque from a crankshaft (not shown) of an internal combustion engine to a camshaft 2. The camshaft 2 of the present embodiment drives intake valves (not shown) among valves of the internal combustion engine to open and close the same through transmission of the engine torque. Therefore, the valve timing control apparatus 1 adjusts the valve timing of the intake valves in accordance with an engine phase between the crankshaft and the camshaft 2.

Hereinafter, a basic structure of the valve timing control apparatus 1 will be described. The valve timing control apparatus 1 includes an actuator 4, an electric power supply control circuit 7 and a phase adjusting mechanism 8.

The actuator 4 is, for example, an electric motor, such as a brushless motor, and includes a motor case 5 and a control shaft 6. The motor case 5 is fixed to a fixation articulation of the internal combustion engine. The control shaft 6 is supported by the motor case 5 such that the control shaft 6 is rotatable in both of a forward rotational direction and a backward rotational direction. The electric power supply control circuit 7 includes a driver and a microcomputer. The microcomputer controls the driver. The electric power supply control circuit 7 is placed in at least one of an exterior and an interior of the motor case 5 and is electrically connected to the actuator 4. The electric power supply control circuit 7 controls a rotational state of the control shaft 6 through energization of the actuator 4.

The phase adjusting mechanism 8 includes a driving-side rotator 10, a driven-side rotator 20, a planetary carrier 40 and a planetary gear 50.

Figure 2:
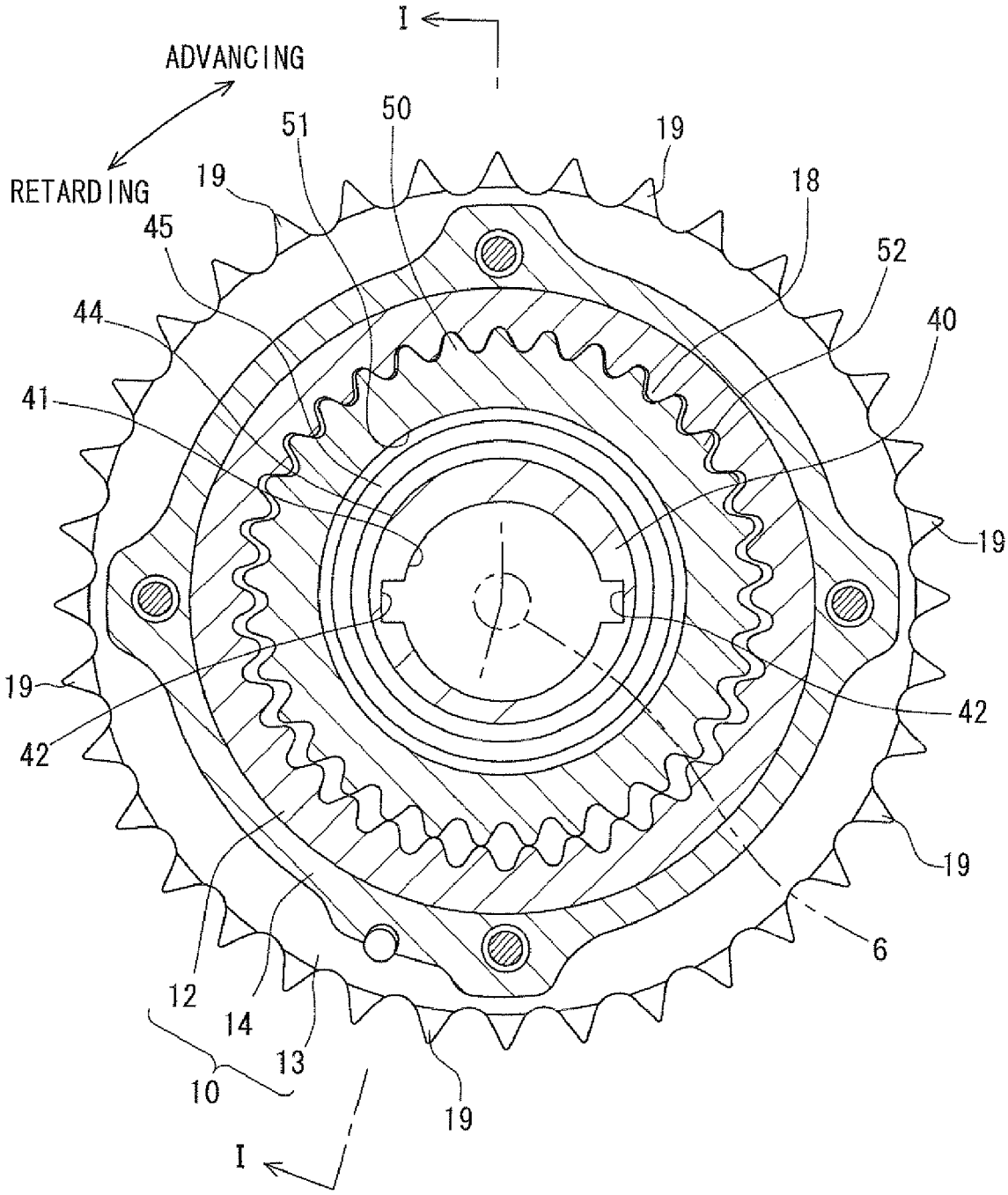
FIG. 2 is a cross-sectional view taken along line II-II in FIG. 1.
Figure 3:
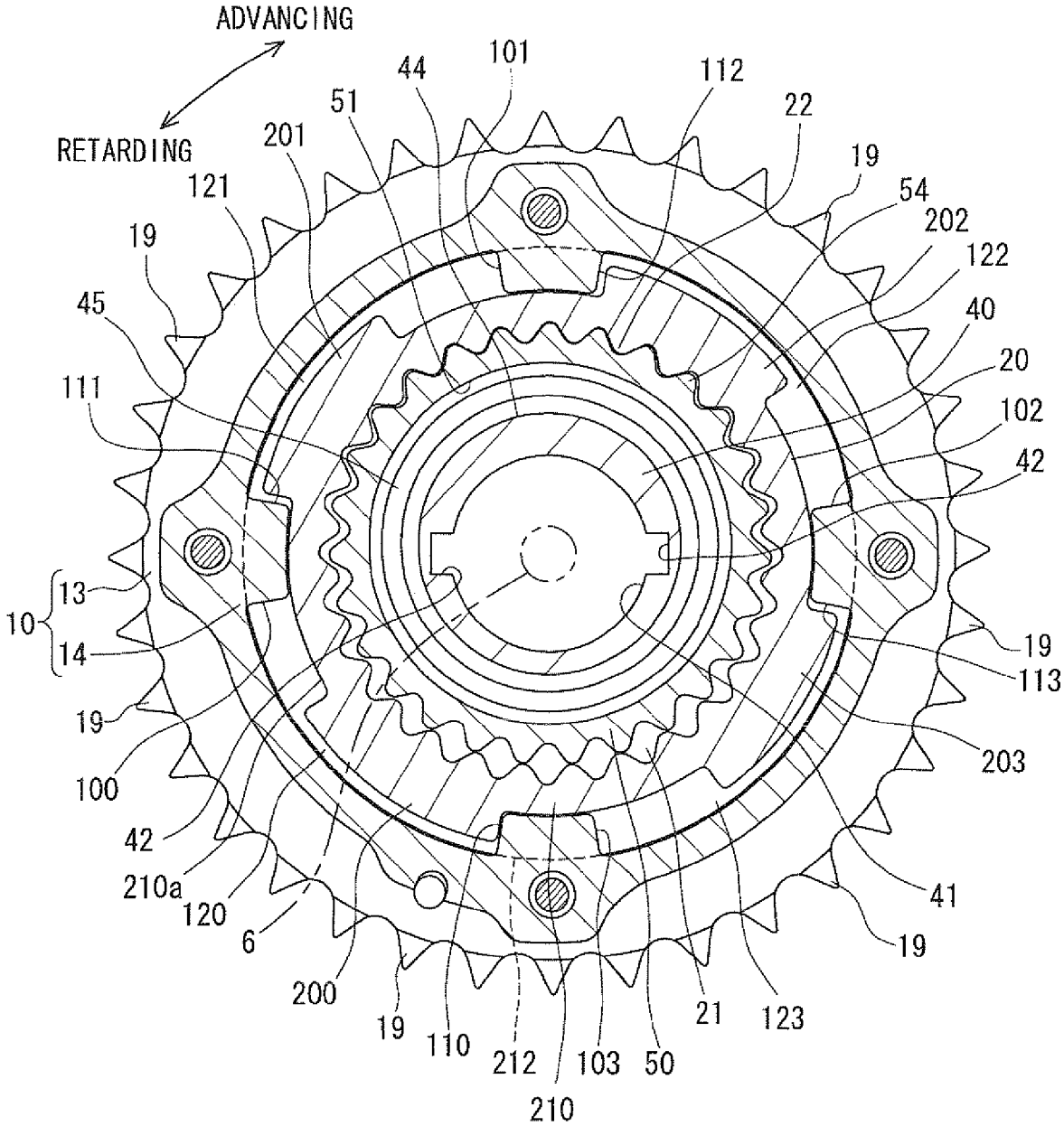
FIG. 3 is a cross-sectional view taken along line III-III in FIG. 1.

As shown in FIGS. 1 to 3, the driving-side rotator 10 is configured into a tubular body and receives other constituent components 20, 40, 50 of the phase adjusting mechanism 8. The driving-side rotator 10 includes a gear member 12, a tubular wall member 14 and a sprocket member 13, which are coaxially held together such that the tubular wall member 14 is held between the gear member 12 and the sprocket member 13.

As shown in FIGS. 1 and 2, a driving-side internal gear portion 18 is formed in a peripheral wall of the gear member 12 and has an addendum circle, which is placed radially inward of a deddendum circle thereof. As shown in FIGS. 1 to 3, the sprocket member 13, which is configured into a stepped cylindrical body, has a plurality of teeth 19 that radially outwardly protrudes from a peripheral wall of the sprocket member 13. The sprocket member 13 is connected to the crankshaft through a timing chain (not shown), which is held between the teeth 19 of the sprocket member 13 and teeth of the crankshaft. When the engine torque is transmitted from the crankshaft to the sprocket member 13 through the timing chain, the driving-side rotator 10 is rotated synchronously with the crankshaft. At this time, a rotational direction of the driving-side rotator 10 is a clockwise direction in FIGS. 2 and 3.

As shown in FIGS. 1 and 3, the driven-side rotator 20 is configured into a cup-shaped body having a bottom wall and a peripheral wall, which extends from the bottom wall. The driven-side rotator 20 is placed radially inward of the tubular wall member 14, which has a diameter larger than that of the driven-side rotator 20, and is coaxial with the tubular wall member 14. The driven-side rotator 20 is held and is supported between the gear member (first-axial side part) 12 and the sprocket member (second-axial side part) 13 of the driving-side rotator 10 in the axial direction. The driven-side rotator 20 has a connecting portion 21 at the bottom wall (right end wall in FIG. 1) of the driven-side rotator 20. The connecting portion 21 is connected and joined to the camshaft 2 through screws in the axial direction. Through this connection, the driven-side rotator 20 is rotatable together with, i.e., synchronously with the camshaft 2 and is rotatable relative to the driving-side rotator 10. Similar to the driving-side rotator 10, the driven-side rotator 20 is rotated in the clockwise direction in FIG. 3.

A driven-side internal gear portion 22 is formed in a peripheral wall of the driven-side rotator 20 and has an addendum circle, which is placed radially inward of a deddendum circle thereof. The driven-side internal gear portion 22 is displaced from the driving-side internal gear portion 18 on a camshaft 2 side of the driving-side internal gear portion 18 in the axial direction. An inner diameter of the driven-side internal gear portion 22 is set to be smaller than an inner diameter of the driving-side internal gear portion 18. The number of teeth of the driven-side internal gear portion 22 is set to be smaller than the number of teeth of the driving-side internal gear portion 18.

As shown in FIGS. 1 to 3, the planetary carrier 40 is configured into a tubular body and has an input portion 41 in an inner peripheral surface of a peripheral wall of the planetary carrier 40. The input portion 41 is coaxially placed relative to the driving-side rotator 10, the driven-side rotator 20 and the control shaft 6. Two engaging grooves 42 are formed in the input portion 41 to engage with a joint 43. The control shaft 6 is connected to the planetary carrier 40 through the joint 43. Through this connection, the planetary carrier 40 is rotatable together with the control shaft 6 and is rotatable relative to the driving-side rotator 10.

Furthermore, an eccentric portion 44, which is eccentric to the input portion 41, is formed in an outer peripheral surface of the peripheral wall of the planetary carrier 40. The eccentric portion 44 is fitted to an inner peripheral side of a center hole 51 of the planetary gear 50 through a bearing 45. Through this fitting, the planetary gear 50 is supported by the eccentric portion 44 and can make a planetary motion in response to the relative rotation of the planetary carrier 40 relative to the driving-side rotator 10. Here, the planetary motion of the planetary gear 50 is made such that the planetary gear 50 revolves in the rotational direction of the planetary carrier 40 while the planetary gear 50 rotates about the eccentric axis of the eccentric portion 44.

The planetary gear 50, which is configured into a stepped cylindrical body, has a driving-side external gear portion 52 and a driven-side external gear portion 54 at axially opposed end parts, respectively, of the peripheral wall of the planetary gear 50. Each of the driving-side external gear portion 52 and the driven-side external gear portion 54 has an addendum circle, which is placed radially outward of a deddendum circle thereof. An outer diameter of the driving-side external gear portion 52 is set to be larger than an outer diameter of the driven-side external gear portion 54. The number of teeth of the driving-side external gear portion 52 is smaller than that of the driving-side internal gear portion 18 by a predetermined number, and the number of teeth of the driven-side external gear portion 54 is smaller than that of the driven-side internal gear portion 22 by the same predetermined number. The driving-side external gear portion 52 is placed radially inward of the driving-side internal gear portion 18 and is meshed with the driving-side internal gear portion 18. The driven-side external gear portion 54, which is placed on the camshaft 2 side of the driving-side external gear portion 52, is placed radially inward of the driven-side internal gear portion 22 and is meshed with the driven-side internal gear portion 22.

As discussed above, the phase adjusting mechanism 8, in which the driving-side rotator 10 and the driven-side rotator 20 are connected through the planetary gear 50, converts the rotational motion of the planetary carrier 40, which corresponds to the rotational state of the control shaft 6, to the planetary motion of the planetary gear 50 to adjust the engine phase that determines the valve timing.

Specifically, when the control shaft 6 is rotated at the same rotational speed as that of the driving-side rotator 10, the planetary carrier 40 does not rotate relative to the driving-side rotator 10, so that the planetary gear 50 is rotated along with the driving-side rotator 10 and the driven-side rotator 20 without making the planetary motion. Therefore, the engine phase does not change, and the valve timing is maintained. In contrast, when the control shaft 6 is rotated at the higher rotational speed, which is higher than the rotational speed of the driving-side rotator 10, the planetary carrier 40 is rotated relative to the driving-side rotator 10 toward the advancing side. Thereby, the planetary gear 50 makes the planetary motion, and the driven-side rotator 20 is rotated relative to the driving-side rotator 10 toward the advancing side. Therefore, the engine phase is changed toward the advancing side, and the valve timing is advanced. In contrast, when the control shaft 6 is rotated at the lower rotational speed, which is lower than the rotational speed of the driving-side rotator 10, or when the control shaft 6 is rotated in the opposite direction, which is opposite from the rotational direction of the driving-side rotator 10, the planetary carrier 40 is rotated relative to the driving-side rotator 10 toward the retarding side. Thereby, the planetary gear 50 makes the planetary motion, and the driven-side rotator 20 is rotated relative to the driving-side rotator 10 toward the retarding side. Therefore, the engine phase is changed toward the retarding side, and the valve timing is retarded.

In the above description, the driving-side rotator 10 corresponds to a first rotator, and the driving-side internal gear portion 18 corresponds to a first gear portion. Furthermore, the driven-side rotator 20 corresponds to a second rotator, and the driven-side internal gear portion 22 corresponds to a second gear portion.

Hereinafter, the characteristic structure of the valve timing control apparatus 1 will be described in detail.

As shown in FIG. 3, the tubular wall member 14 of the driving-side rotator 10 has a plurality of advancing-side contact portions 100-103 and a plurality of retarding-side contact portions 110-113, each of which is configured as a radially extending surface extending radially inwardly from an inner peripheral surface of the peripheral wall of the tubular wall member 14. The advancing-side contact portions 100-103 are placed one after another in the rotational direction (circumferential direction). Similarly, the retarding-side contact portions 110-113 are placed one after another in the rotational direction. More specifically, the advancing-side contact portion 100 and the retarding-side contact portion 110 are opposed to each other in the rotational direction such that a gap 120 is interposed between the advancing-side contact portion 100 and the retarding-side contact portion 110. Also, the advancing-side contact portion 101 and the retarding-side contact portion 111 are opposed to each other in the rotational direction such that a gap 121 is interposed between the advancing-side contact portion 101 and the retarding-side contact portion 111. Furthermore, the advancing-side contact portion 102 and the retarding-side contact portion 112 are opposed to each other in the rotational direction such that a gap 122 is interposed between the advancing-side contact portion 102 and the retarding-side contact portion 112. In addition, the advancing-side contact portion 103 and the retarding-side contact portion 113 are opposed to each other in the rotational direction such that a gap 123 is interposed between the advancing-side contact portion 103 and the retarding-side contact portion 113.

Figure 4:
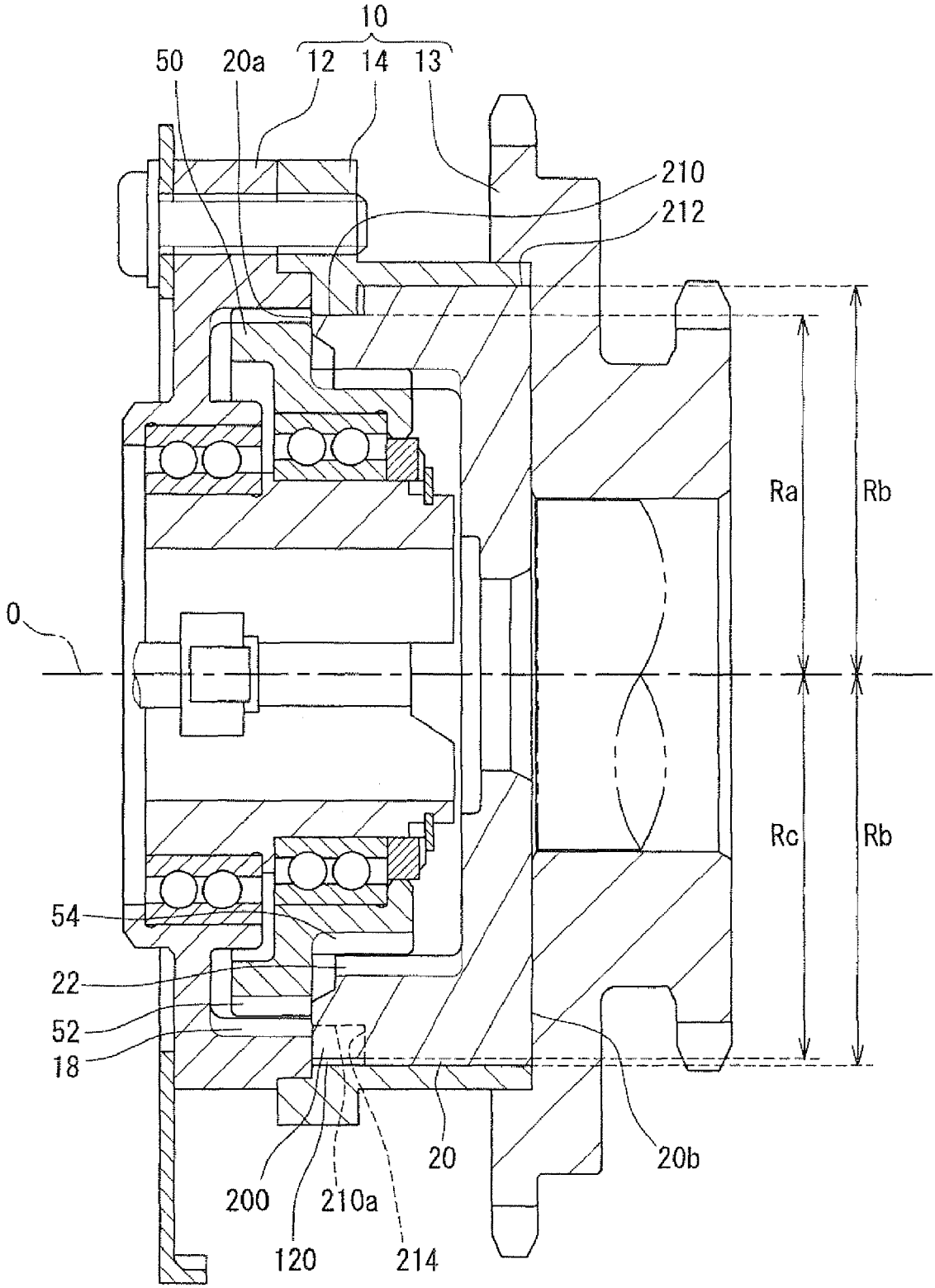
FIG. 4 is a cross-sectional view showing a characteristic feature of the valve timing control apparatus according to the embodiment.

As shown in FIGS. 3 and 4, the driven-side rotator 20 has a plurality of stopper portions 200-203, which radially outwardly project from the peripheral wall of the driven-side rotator 20 away from the driven-side internal gear portion 22 and are placed one after another in the rotational direction. The stopper portions 200-203 are received in the gaps 120-123, respectively, in a manner that enables a swing motion of the stopper portions 200-203.

In the present embodiment, which provides the above stopper structure, when the stopper portion 200 contacts the advancing-side contact portion 100, which is located on the advancing side of the stopper portion 200, the relative rotation of the driven-side rotator 20 relative to the driving-side rotator 10 toward the advancing side is limited (disabled), i.e., the change in the engine phase toward the advancing side is limited (disabled). In contrast, when the stopper portion 200 contacts the retarding-side contact portion 110, which is located on the retarding side of the stopper portion 200, the relative rotation of the driven-side rotator 20 relative to the driving-side rotator 10 toward the retarding side is limited (disabled), i.e., the change in the engine phase toward the retarding side is limited (disabled). Furthermore, when the stopper portion 200 is circumferentially spaced from the advancing-side contact portion 100 toward the retarding side and is also circumferentially spaced from the retarding-side contact portion 110 toward the advancing side, the relative rotation of the driven-side rotator 20 relative to the driving-side rotator 10 is enabled, i.e., the change in the engine phase is enabled.

The arrangement of the advancing-side contact portion 101, the retarding-side contact portion 111 and the stopper portion 201, the arrangement of the advancing-side contact portion 102, the retarding-side contact portion 112 and the stopper portion 202, and the arrangement of the advancing-side contact portion 103, the retarding-side contact portion 113 and the stopper portion 203 are provided for the backup purpose to implement the above-described phase change disabling function or phase change enabling function at the time of occurrence of an abnormality in the arrangement of the advancing-side contact portion 100, the retarding-side contact portion 110 and the stopper portion 200.

As shown in FIGS. 3 to 4, the driven-side rotator 20 is configured into the stepped cup-shaped body and has a small diameter portion 210 and a large diameter portion 212 at opposed axial end parts, respectively, of the peripheral wall of the driven-side rotator 20.

The small diameter portion 210, which forms an opening side end part **20*a* of the driven-side rotator 20, is axially adjacent to the gear member 12 of the driving-side rotator 10 and the driving-side external gear portion 52 of the planetary gear 50. The small diameter portion 210 has a constant outer radius (radial size) Ra, which is measured from the rotational axis O of the driven-side rotator 20 to a radially outer peripheral surface of the small diameter portion 210 located between the circumferentially adjacent ones of the stopper portions 200-203**.

The large diameter portion 212, which forms a bottom wall side end part **20*b* of the driven-side rotator 20, is axially adjacent to the sprocket member 13 of the driving-side rotator 10. An outer radius (radial size) Rb of the large diameter portion 212, which is measured from the rotational axis O of the driven-side rotator 20 to a radially outer peripheral surface of the large diameter portion 212, is set to be larger than the outer radius Ra of the small diameter portion 210 and also larger than an outer radius (radial size) Rc of each stopper portion 200-203, which is measured from the rotational axis O of the driven-side rotator 20 to a radially outer peripheral surface of the stopper portion 200-203. In other words, the large diameter portion 212, which is configured into a generally cylindrical form, has an outer diameter (Rb+Rb) larger than an outer diameter (Ra+Ra) of the small diameter portion 210, which is configured into a generally cylindrical form, and each stopper 200-203 radially outwardly projects from the small diameter portion 210 without extending beyond the large diameter portion 212** in the radial direction.

A radially extending section (step-to-step transition portion) 214, which has a radially extending surface, radially connects between the small diameter portion 210, which has the outer radius Ra, and the large diameter portion 212, which has the outer radius Rb. The radially extending section 214 is continuous from, i.e., is directly connected to the stopper portions 200-203, each of which has the outer radius Rc. In this way, the radially extending section 214 reinforces the stopper portions 200-203 from the camshaft 2 side. Therefore, in the abnormal time, even when the stopper portion 200 collides against the driving-side rotator 10 at a high speed to cause generation of the large impact, it is possible to limit occurrence of a damage.

Figure 5A:
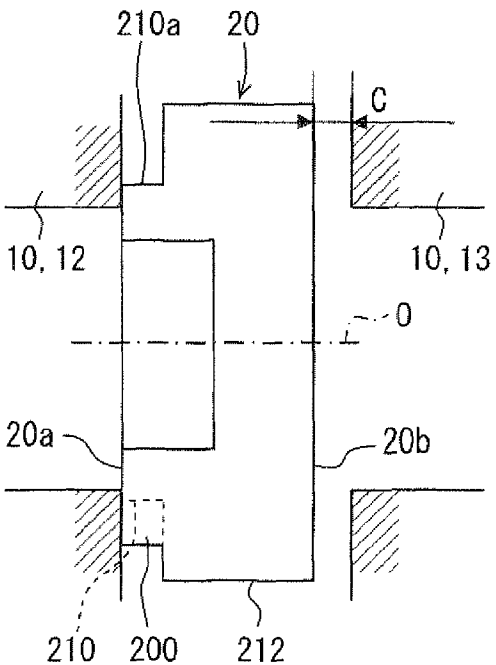
FIGS. 5A to 5C are diagrams for describing the characteristic feature of the valve timing control apparatus according to the embodiment.
Figure 5B:
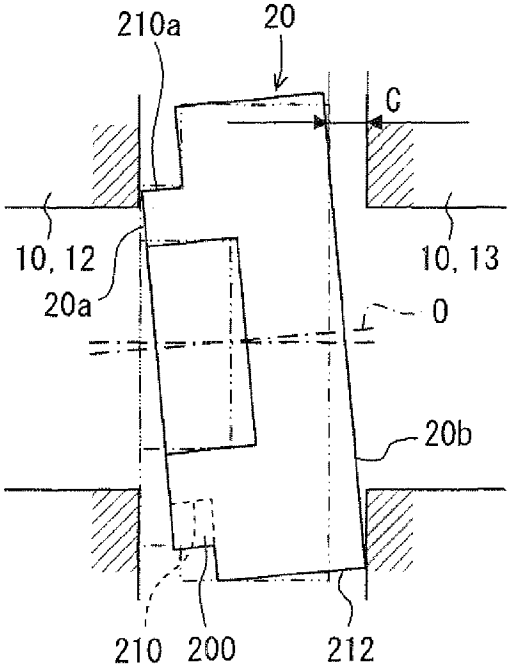
Figure 5C:
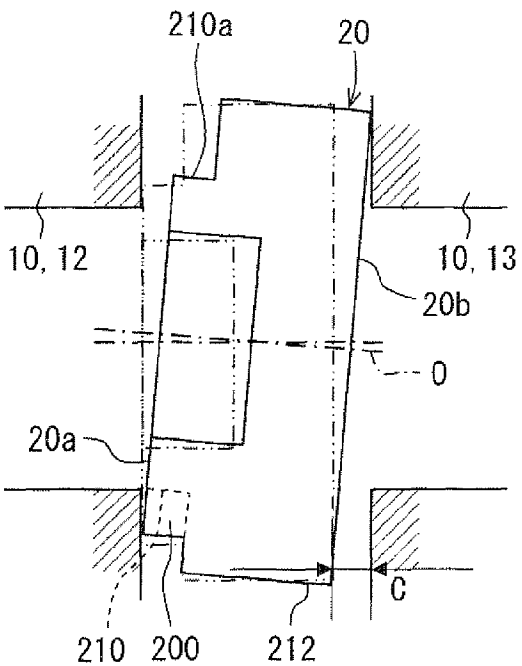

In the present embodiment, the driving-side rotator 10 has the gear member 12 and the sprocket member 13, between which the small diameter portion 210 and the large diameter portion 212 of the driven-side rotator 20 are axially held and supported. As shown in FIG. 5A, an axial support clearance C needs to be provided between the driving-side rotator 10 and the driven-side rotator 20. Therefore, as shown in FIGS. 5B and 5C, the rotational axis O of the driven-side rotator 20 can be easily tilted relative to the driving-side rotator 10 by the amount, which corresponds to the support clearance C, due to, for example, a change in the cam torque directly transmitted from the camshaft 2. FIG. 5B indicates the state where at the one end part 20*a* of the driven-side rotator 20, a non-protruding portion 210*a* (see FIGS. 3 and 4) of the small diameter portion 210, which is circumferentially located between the circumferentially adjacent stopper portion 200-203, contacts the gear member 12 of the driving-side rotator 10. FIG. 5C indicates the state where at the one end part 20*a* of the driven-side rotator 20, the stopper portion 200, which radially outwardly projects from the small diameter portion 210, contacts the gear member 12 of the driving-side rotator 10.

In the present embodiment, at the other end part 20*b* of the driven-side rotator 20, at which the stopper portions 200-203 are not formed, the large diameter portion 212, which has the outer radius larger than that of the stopper portion 200-203, contacts the sprocket member 13 of the driving-side rotator 10. Therefore, in comparison to the prior art case where the small diameter portion 1212 of the second rotator 1020, which is located radially inward of the stopper portion 1200, contacts the first rotator 1010 at the other axial end part 1020*b*, at which the stopper portion 1200 is not formed, it is possible to limit the tilt of the rotational axis O without increasing the outer radius Rc of the respective stopper portions 200-203. That is, the amount of tilt of the driven-side rotator 20, which changes from time to time depending on the contact location of the driven-side rotator 20 relative to the driving-side rotator 10, can be reduced. Therefore, even in the case where the driven-side rotator 20 is placed axially adjacent to the planetary gear 50, which is meshed with the driven-side internal gear portion 22, it is possible to limit or minimize the generation of the frictional wearing and/or noises.

The present invention has been described with respect to the embodiment of the present invention. However, the present invention is not limited to the above embodiment, and the above embodiment may be modified in various ways within a spirit and scope of the present invention.

Figure 6:
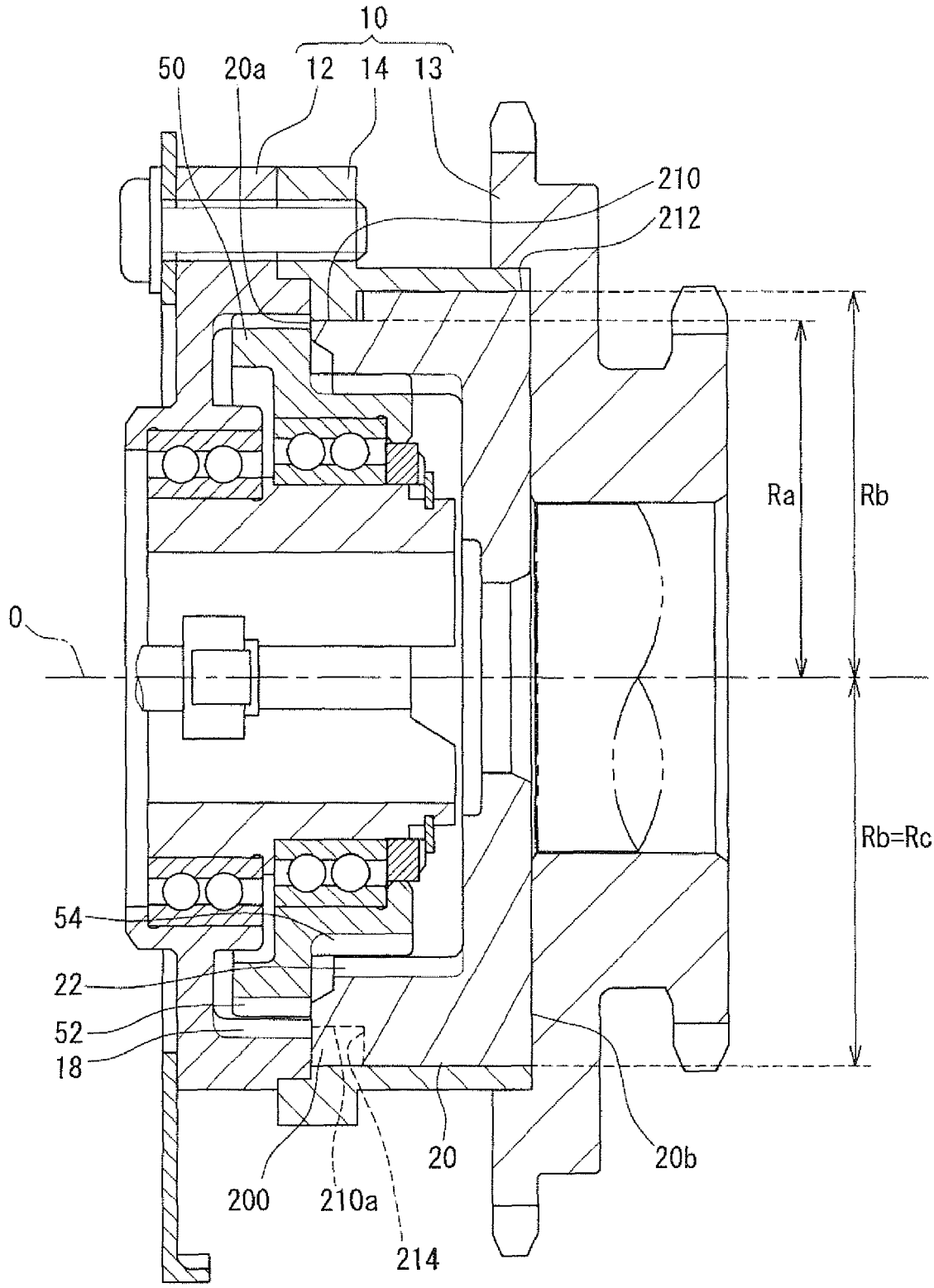
FIG. 6 is a schematic cross-sectional view, showing a modification of the structure shown in FIG. 4.
Figure 7:
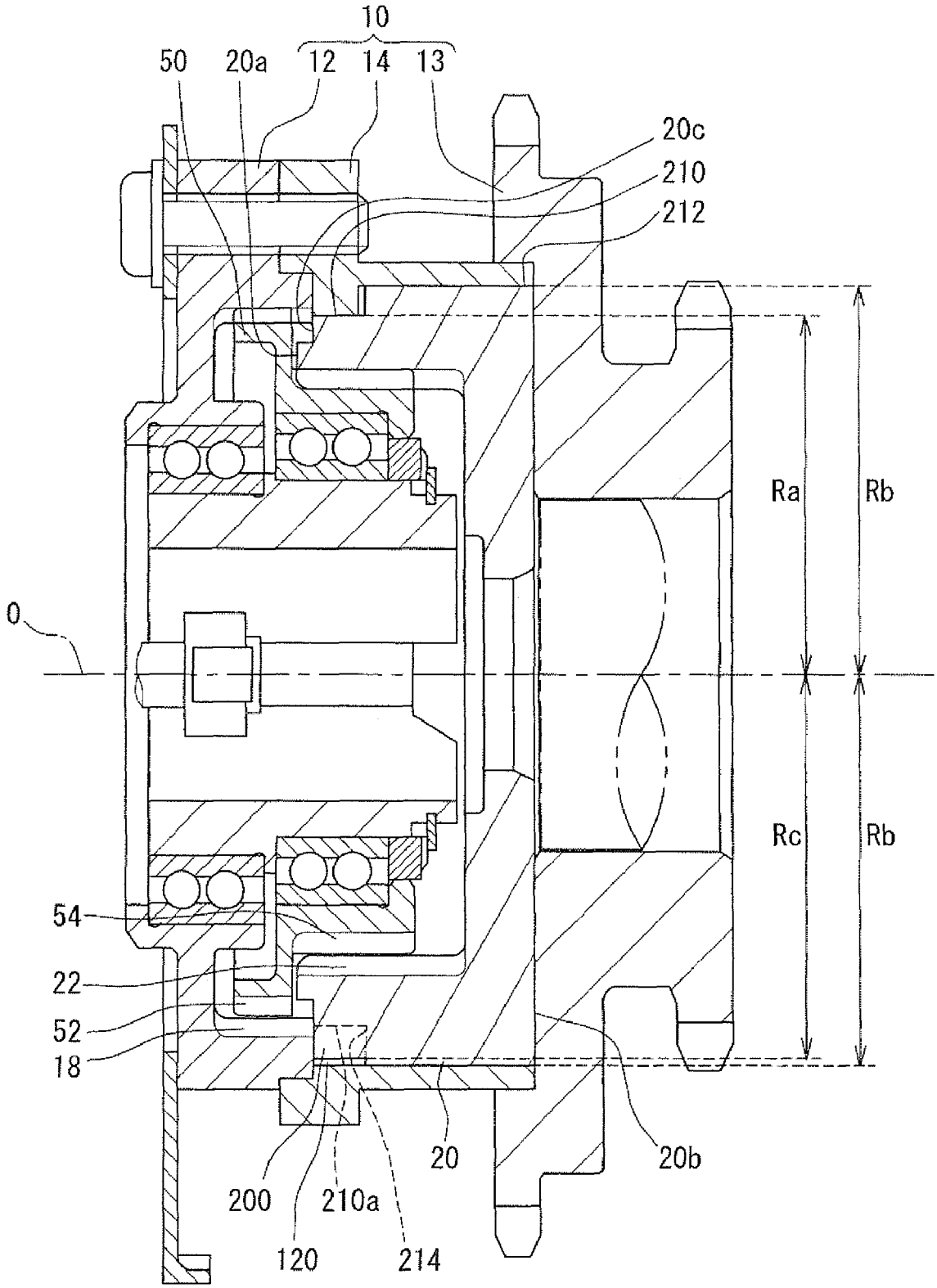
FIG. 7 is a schematic cross-sectional view, showing another modification of the structure shown in FIG. 4.
Figure 8A:
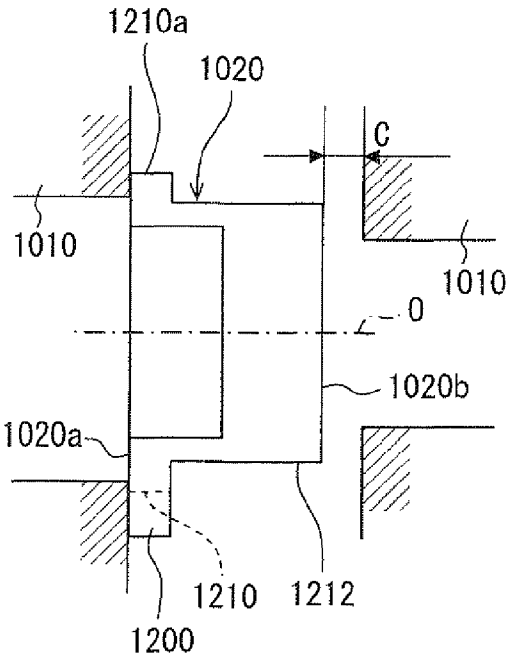
FIG. 8A PRIOR ART
FIGS. 8A to 8C are diagrams showing a valve timing control apparatus according to a prior art.
Figure 8B:
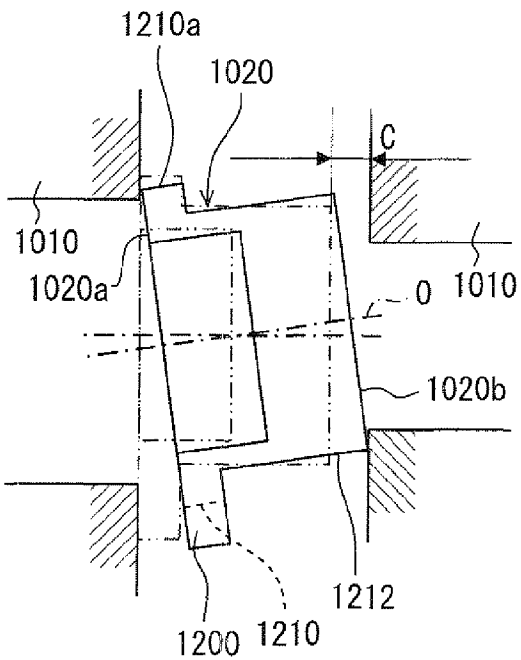
FIG. 8B PRIOR ART
Figure 8C:
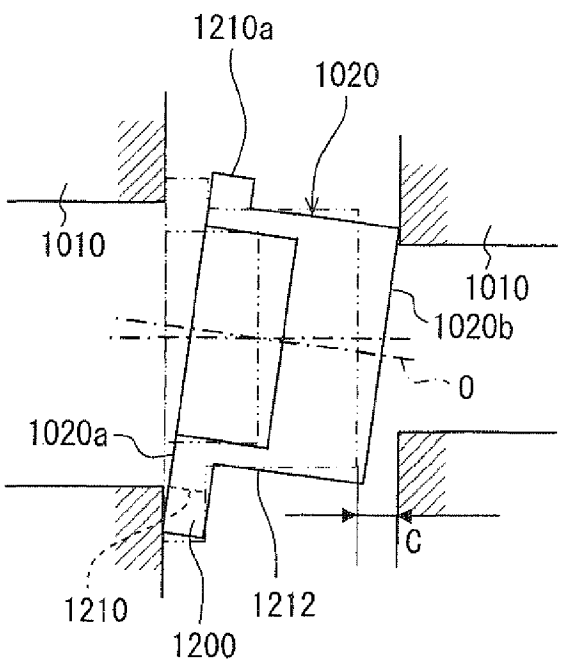
FIG. 8C PRIOR ART

Specifically, it is only required to set the outer radius Rb of the large diameter portion 212 of the driven-side rotator 20 equal to or larger than the outer radius Rc of the stopper portion 200-203. For example, as shown in FIG. 6, which indicates a modification of the above embodiment, the outer radius Rb of the large diameter portion 212 of the driven-side rotator 20 may be set to be equal to the outer radius Rc of the stopper portion 200-203. Also, it is only required that the small diameter portion 210 and the large diameter portion 212 of the driven-side rotator 20 are supported from the opposed axial sides thereof by the driving-side rotator 10. For instance, as shown in FIG. 7, which shows another modification of the embodiment, the end part 20*a*, which has the small outer radius, may be axially projected on the side, which is opposite from the large diameter portion 212, away from the small diameter portion 210. Furthermore, the end surface 20*c* of the small diameter portion 210, from which the end part 20*a* axially projects, may be placed adjacent to the driving-side rotator 10 and the planetary gear 50 in the axial direction. Furthermore, the driven-side rotator 20 may be placed adjacent to the planetary gear 50 in the axial direction. Furthermore, the stopper portions 200-203 of the driven-side rotator 20 may be spaced from the radially extending section 214 between the small diameter portion 210 and the large diameter portion 212, so that the stopper portions 200-203 of the driven-side rotator 20 may be not continuously formed from the radially extending section 214.

In addition, at least one of the gear portion 22 of the driven-side rotator 20 and the gear portion 18 of the driving-side rotator 10 may be formed as an external gear portion that has an addendum circle, which is placed radially outward of a deddendum circle thereof. In such a case, the corresponding at least one of the driving-side external gear portion 52 and the driven-side external gear portion 54 may be formed as an internal gear portion that has an addendum circle, which is placed radially inward of a deddendum circle thereof. The present invention is also applicable to any other type of valve timing control apparatus, which controls valve timing of exhaust valves or which controls both of the valve timing of the intake valves and the valve timing of the exhaust valves.

Additional advantages and modifications will readily occur to those skilled in the art. The invention in its broader terms is therefore not limited to the specific details, representative apparatus, and illustrative examples shown and described.

What is claimed is:

1. A valve timing control apparatus comprising:

a first rotator that is rotatable synchronously with one of a crankshaft and a camshaft of an internal combustion engine, wherein the first rotator includes a first gear portion;

a second rotator that is coaxially received in the first rotator and is supported at both sides of the second rotator in an axial direction by the first rotator, wherein the second rotator is rotatable synchronously with the other one of the crankshaft and the camshaft and includes:

a stopper portion that is adapted to contact the first rotator in a rotational direction to limit a change in a relative phase between the crankshaft and the camshaft; and a second gear portion; and a planetary gear that is meshed with the first gear portion and the second gear portion and is adapted to make a planetary motion and thereby to change the relative phase between the crankshaft and the camshaft, wherein:

valve timing of a valve, which is opened and closed by the camshaft, is adjusted through transmission of a torque from the crankshaft;

the second rotator includes:

a small diameter portion, from which the stopper portion projects radially outward at a circumferential part of the small diameter portion; and a large diameter portion, which has an outer diameter that is equal to or larger than an outer diameter of the stopper portion with respect to a rotational axis of the second rotator; and the small diameter portion and the large diameter portion of the second rotator are supported at the both sides of the second rotator in the axial direction by the first rotator.

2. The valve timing control apparatus according to claim 1, wherein the outer diameter of the large diameter portion of the second rotator is larger than the outer diameter of the stopper portion.

3. The valve timing control apparatus according to claim 1, wherein the second rotator has the small diameter portion at one axial end part of the second rotator and the large diameter portion at the other axial end part of the second rotator, which is opposite from the one axial end part of the second rotator.

4. The valve timing control apparatus according to claim 1, wherein the second rotator is received in the first rotator, which is rotatable synchronously with the crankshaft, and is rotatable synchronously with the camshaft, which is joined to the second rotator in the axial direction.

5. The valve timing control apparatus according to claim 1, wherein the second rotator is placed adjacent to the planetary gear in the axial direction.

6. The valve timing control apparatus according to claim 1, wherein:

the second rotator includes a radially extending section, which connects between the small diameter portion and the large diameter portion; and the stopper portion is continuous from the radially extending section in the axial direction.

* * * * *